US010153587B1

(12) United States Patent
Lai

(10) Patent No.: US 10,153,587 B1
(45) Date of Patent: Dec. 11, 2018

(54) PLUG-AND-SOCKET CONNECTOR ASSEMBLY

(71) Applicant: YUNG LI CO., LTD., New Taipei (TW)

(72) Inventor: Shao-Chiang Lai, New Taipei (TW)

(73) Assignee: Yung Li Co., LTD., New Taipei (TW)

( * ) Notice: Subject to any disclaimer, the term of this patent is extended or adjusted under 35 U.S.C. 154(b) by 0 days.

(21) Appl. No.: 15/665,882

(22) Filed: Aug. 1, 2017

(30) Foreign Application Priority Data

Jun. 7, 2017 (TW) ..... 106118806 A

(51) Int. Cl.
*H01R 13/627* (2006.01)
*H01R 24/30* (2011.01)
*H01R 103/00* (2006.01)

(52) U.S. Cl.
CPC ..... *H01R 13/6273* (2013.01); *H01R 24/30* (2013.01); *H01R 2103/00* (2013.01)

(58) Field of Classification Search
CPC ..... H01R 24/30; H01R 2105/00; H01R 2107/00; H01R 2201/26; H01R 13/639; H01R 13/62
USPC ..... 439/354, 345, 116, 144, 153, 296, 298, 439/308
See application file for complete search history.

(56) References Cited

U.S. PATENT DOCUMENTS 4,089,579 A * 5/1978 Steinbach ..... H01R 13/6273 439/353
4,526,431 A * 7/1985 Kasukawa ..... G02B 6/3877 439/153
5,041,025 A * 8/1991 Haitmanek ..... H01R 13/6456 439/354
5,080,603 A * 1/1992 Mouissie ..... H01R 23/10 439/353
5,924,885 A * 7/1999 Pacher ..... H01R 13/6273 439/352
6,022,239 A * 2/2000 Wright ..... H01R 13/6273 439/354
8,469,734 B2 * 6/2013 Chen ..... H01R 13/506 439/353

* cited by examiner

*Primary Examiner* — Harshad C Patel
(74) *Attorney, Agent, or Firm* — LeClairRyan

(57) ABSTRACT

A plug-and-socket connector assembly includes an electrical plug connector which includes two retaining tongues each having an actuating free end and a retaining region, and an electrical socket connector which includes two lugs each having a locking hole. When the electrical socket connector is brought into mating engagement with the electrical plug connector, the retaining region is snap-fitted in the locking hole of a corresponding one of the lugs. The actuating free ends of the retaining tongues can be manually pressed toward each other against the biasing forces of the retaining tongues to disengage the retaining regions of the retaining tongues from the locking holes of the lugs so as to permit removal of the electrical plug connector.

3 Claims, 6 Drawing Sheets

PLUG-AND-SOCKET CONNECTOR ASSEMBLY

CROSS-REFERENCE TO RELATED APPLICATION

This application claims priority from Taiwanese patent application no. 106118806, filed on Jun. 7, 2017.

FIELD

The disclosure relates to an electrical connector, more particularly to a plug-and-socket connector assembly.

BACKGROUND

A conventional plug-and-socket connector assembly normally includes an electrical plug connector and an electrical socket connector. The electrical plug connector includes a main body with a plurality of plug pins, and a shroud extending to surround the plug pins. The electrical socket connector has a plurality of socket holes for respectively receiving the plug pins, a plurality of terminals disposed respectively in the socket holes for electrical contact respectively with the plug pins, and an annular groove for receiving the shroud. U.S. Pat. No. 4,493,517 discloses a conventional electrical socket connector. Sometimes, the electrical plug connector may be undesirably detached from the electrical socket connector.

SUMMARY

An object of the disclosure is to provide plug-and-socket connector assembly in which an electrical plug connector is less likely to be undesirably detached from an electrical socket connector.

According to the disclosure, a plug-and-socket connector assembly includes an electrical plug connector and an electrical socket connector. The electrical plug connector includes a main body with a plurality of plug pins extending in a longitudinal direction, and a shroud which is made of an insulating material, and which extends from the main body in the longitudinal direction to surround the plug pins and to define an accommodation space. The shroud has two sidewalls opposite to each other in a transverse direction relative to the longitudinal direction. The electrical socket connector is configured to be brought into mating engagement with the electrical plug connector, and includes a socket body, a flange, a plurality of socket holes, and a plurality of terminals. The socket body is made of an insulating material, and has a central body portion configured to be received in the accommodation space, a peripheral portion, and a clearance which is formed between the central body portion and the peripheral portion, and which is configured to accommodate the shroud. The flange extends radially from the peripheral portion, and has a forward surface. The socket holes are formed in the central body portion, and are configured to respectively receive the plug pins when the shroud is received in the clearance. The terminals are respectively disposed in the socket holes, and are configured to be brought into electrical contact with the plug pins, respectively. The electrical socket connector further includes two lugs which extend forwardly and respectively from the forward surface of the flange in the longitudinal direction, and which are spaced apart from each other in the transverse direction so as to permit the lugs to be disposed outboard of the shroud when the electrical socket connector is brought into mating engagement with the electrical plug connector. Each of the lugs has a locking hole. The electrical plug connector further includes two retaining tongues each being formed by slitting a corresponding one of the sidewalls along two lengthwise lines and an interconnecting line so as to vest the retaining tongue with a biasing force. Each of the retaining tongues has an actuating free end proximate to the main body, and a retaining region distal from the main body such that (i) when the electrical socket connector is brought into mating engagement with the electrical plug connector, the retaining region is snap-fitted in the locking hole of a corresponding one of the lugs, and (ii) if the electrical plug connector is intended to be removed from the electrical socket connector, the actuating free ends of the retaining tongues are manually pressed toward each other against the biasing forces of the retaining tongues to disengage the retaining regions of the retaining tongues from the locking holes of the lugs so as to permit removal of the electrical plug connector.

BRIEF DESCRIPTION OF THE DRAWINGS

Other features and advantages of the disclosure will become apparent in the following detailed description of the embodiment with reference to the accompanying drawings, in which.

DETAILED DESCRIPTION

Figure 1:
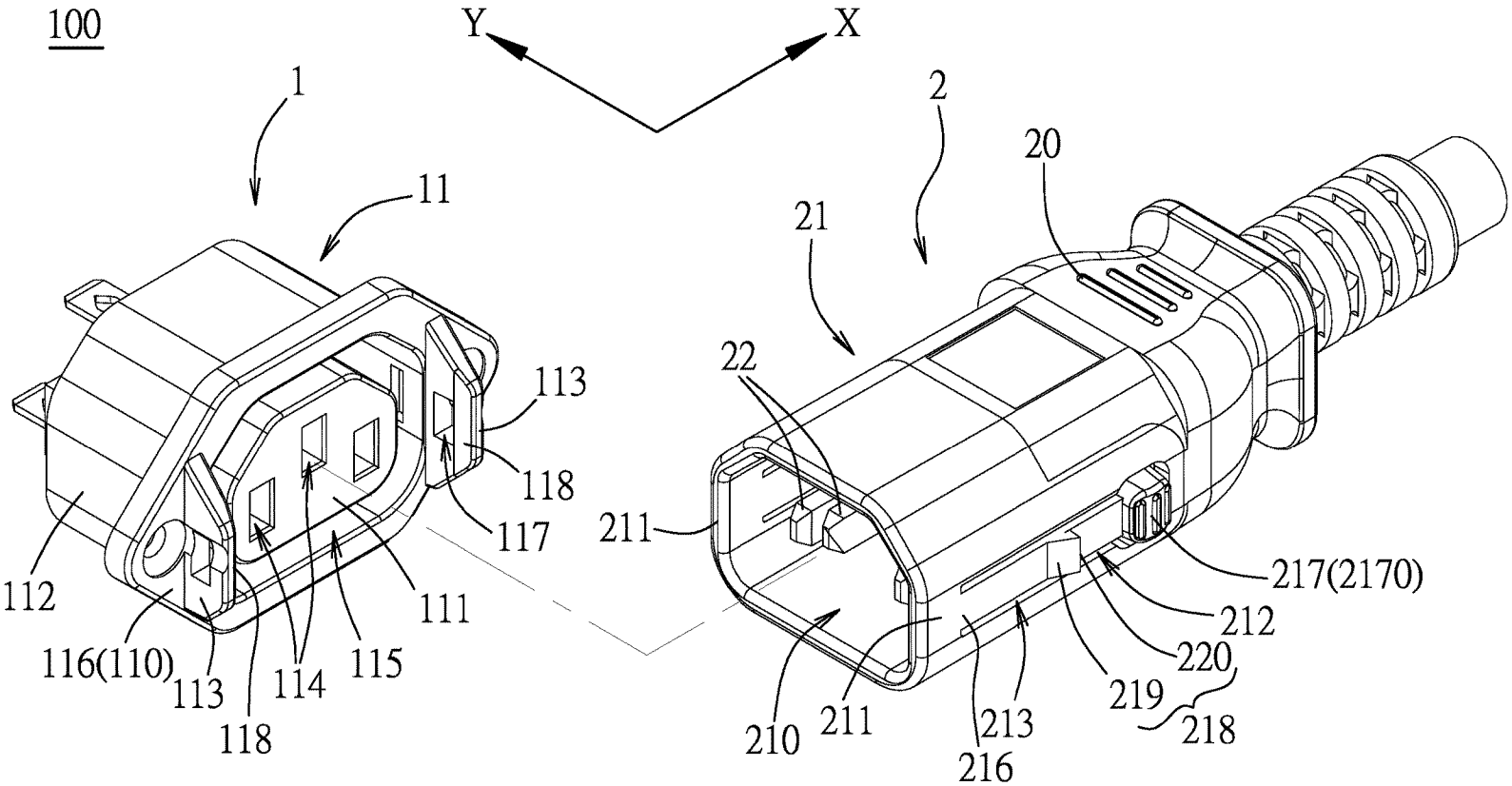
FIG. 1 is a perspective view illustrating of an electrical plug connector and an electrical socket connector of a plug-and socket connector assembly according to an embodiment of the disclosure.
Figure 3:
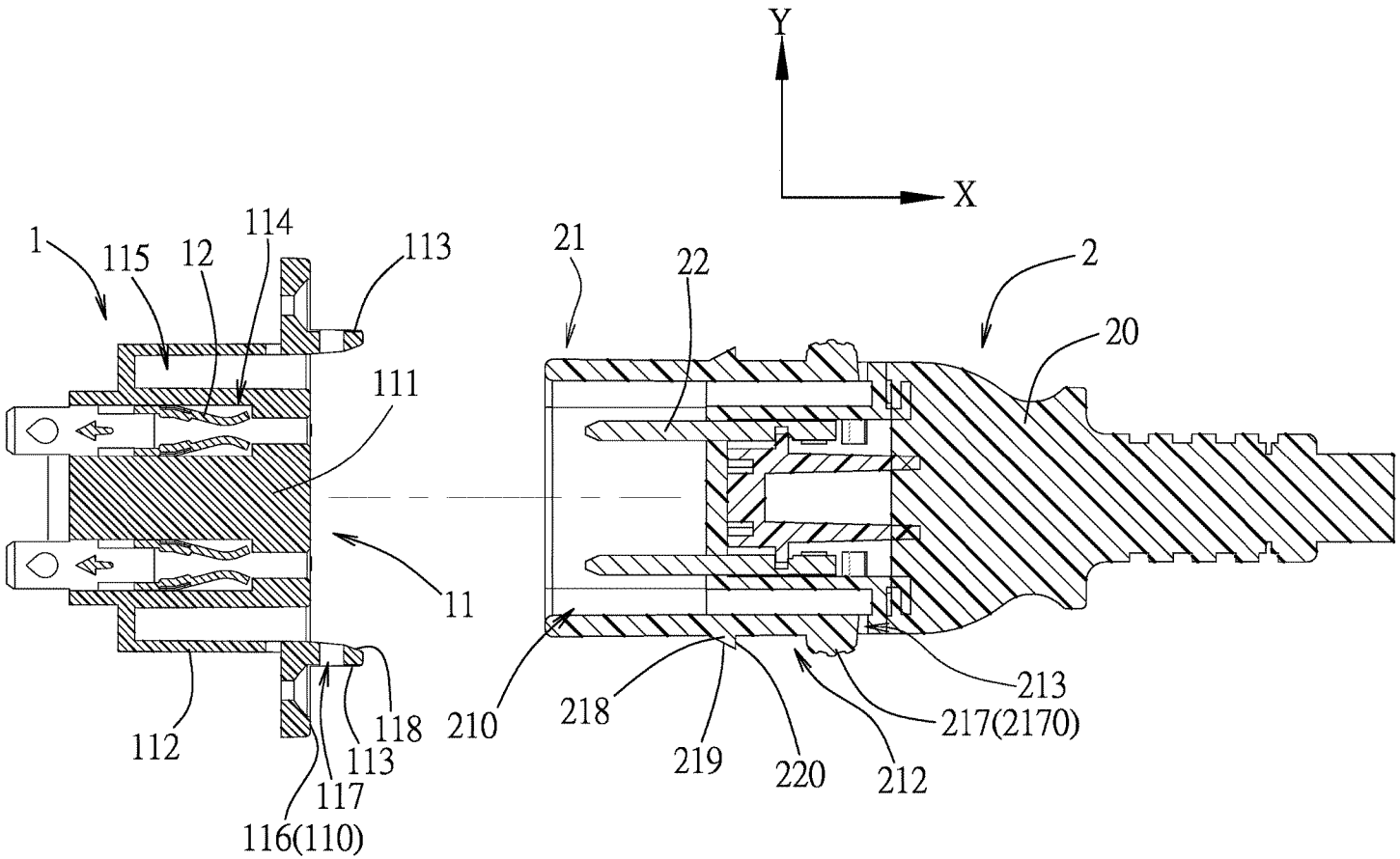
FIG. 3 is a cross-sectional view of the electrical plug connector and the electrical socket connector.

Referring to FIGS. 1 and 3, a plug-and-socket connector assembly 100 according to an embodiment of the disclosure is shown to include an electrical socket connector 1 and an electrical plug connector 2.

The electrical plug connector 2 includes a main body 20 with a plurality of plug pins 22 extending in a longitudinal direction (X), and a shroud 21 which is made of an insulating material, and which extends from the main body 20 in the longitudinal direction (X) to surround the plug pins 22 and to define an accommodation space 210. The shroud 21 has two sidewalls 211 opposite to each other in a transverse direction (Y) relative to the longitudinal direction (X).

Figure 5:
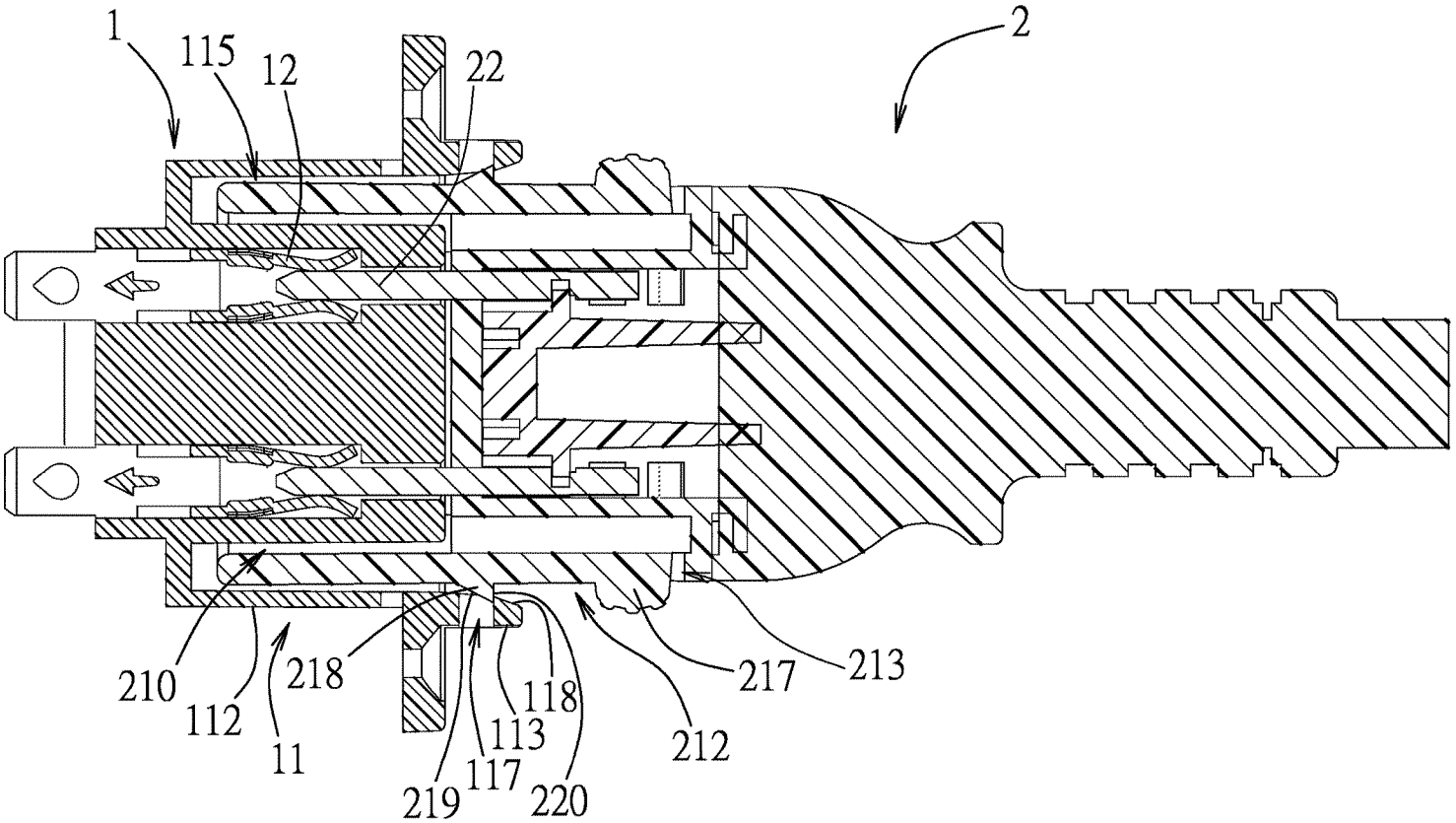

The electrical socket connector 1 is configured to be brought into mating engagement with the electrical plug connector 2 for electricity transmission (see FIG. 5). Referring back to FIGS. 1 and 3, it can be observed that the electrical socket connector 1 includes a socket body 11, a flange 116, a plurality of socket holes 114, and a plurality of terminals 12.

Figure 4:
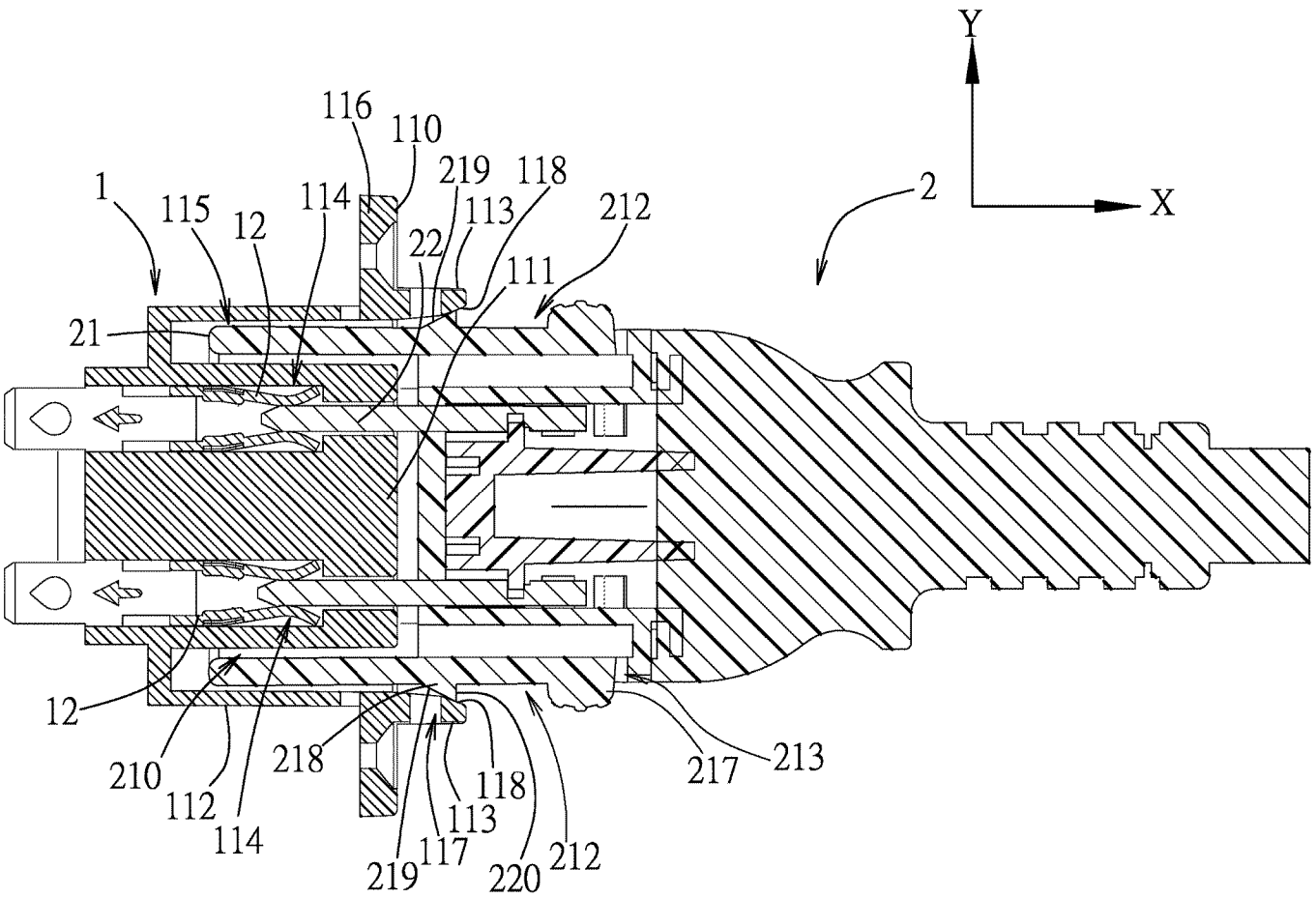
FIGS. 4 and 5 are similar to FIG. 3 but illustrating the electrical socket connector to be brought into mating engagement with the electrical plug connector.

The socket body 11 is made of an insulating material, and has a central body portion 111, a peripheral portion 112, and a clearance 115. As shown in FIG. 4, the central body portion 111 is configured to be received in the accommodation space 210. The clearance 115 is formed between the central body portion 111 and the peripheral portion 112, and is configured to accommodate the shroud 21.

The flange 116 extends radially from the peripheral portion 112, and has a forward surface 110.

The socket holes 114 are formed in the central body portion 111, and are configured to respectively receive the plug pins 22 when the shroud 21 is received in the clearance 115.

The terminals 12 are respectively disposed in the socket holes 114, and are configured to be brought into electrical contact with the plug pins 22, respectively.

To prevent undesirable disassembly of the plug-and-socket connector assembly, the electrical socket connector 1 further includes two lugs 113, and the electrical plug connector 2 further includes two retaining tongues 212.

The two lugs 113 extend forwardly and respectively from the forward surface 110 of the flange 116 in the longitudinal direction (X), and are spaced apart from each other in the transverse direction (Y) so as to permit the lugs 113 to be disposed outboard of the shroud 21 when the electrical socket connector 1 is brought into mating engagement with the electrical plug connector 2 (see FIG. 4). Each of the lugs 113 has a locking hole 117.

Figure 2:
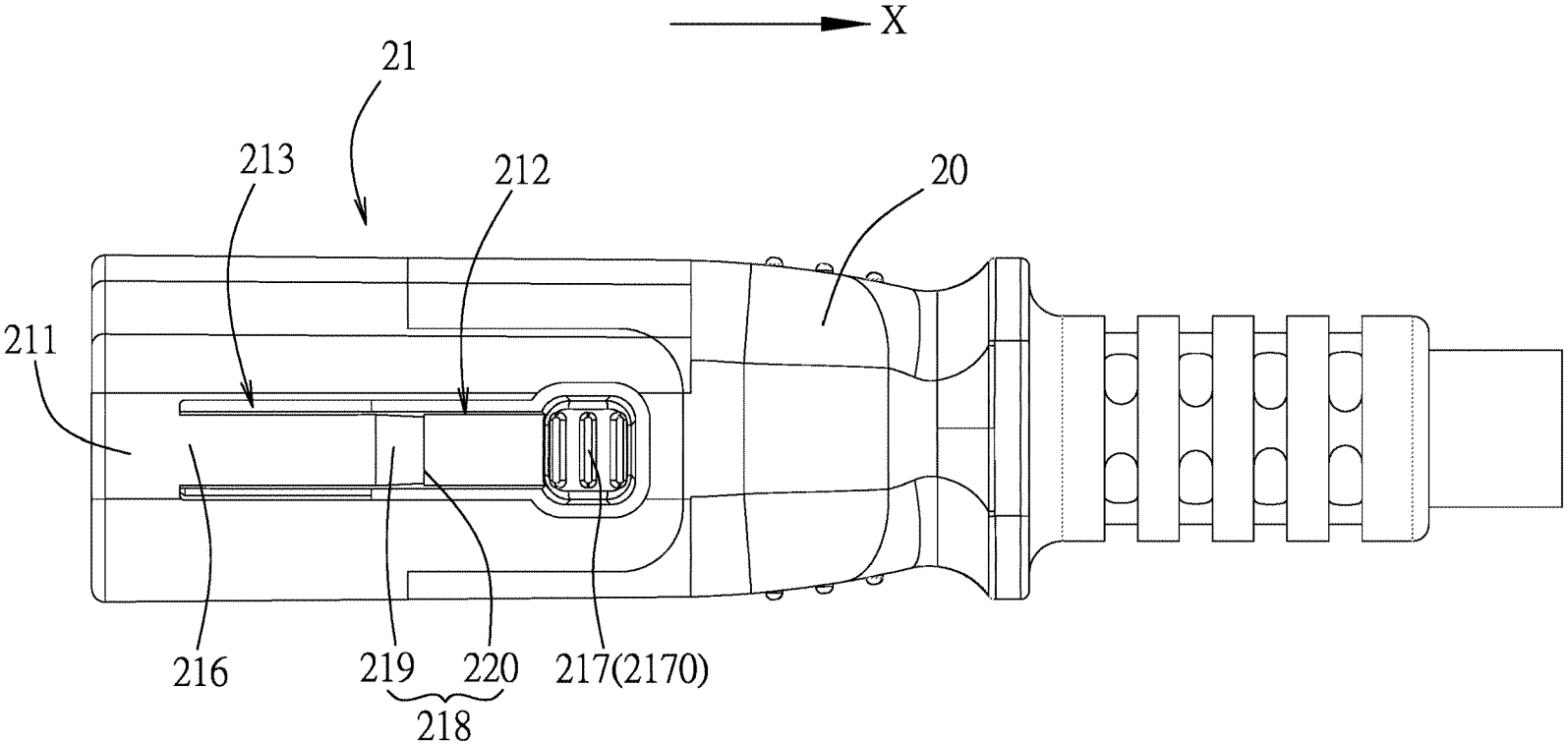
FIG. 2 is a side view of the electrical plug connector.

As shown in FIGS. 2 and 3, each of the two retaining tongues 212 is formed by slitting a corresponding one of the sidewalls 211 along two lengthwise lines and an interconnecting line so as to vest the retaining tongue 212 with a biasing force, and so as to forma slit groove 213 in spatial communication with the accommodation space 210. Each of the retaining tongues 212 has a connected end 216 connected to a corresponding one of the sidewalls 211, an actuating free end 217 proximate to the main body 20, and a retaining region 218 which is distal from the main body 20 and which is disposed between the connected end 216 and the actuating free end 217.

As shown in FIGS. 4 and 5, when the electrical socket connector 1 is brought into mating engagement with the electrical plug connector 2, the retaining region 218 is snap-fitted in the locking hole 117 of a corresponding one of the lugs 113.

Figure 6:
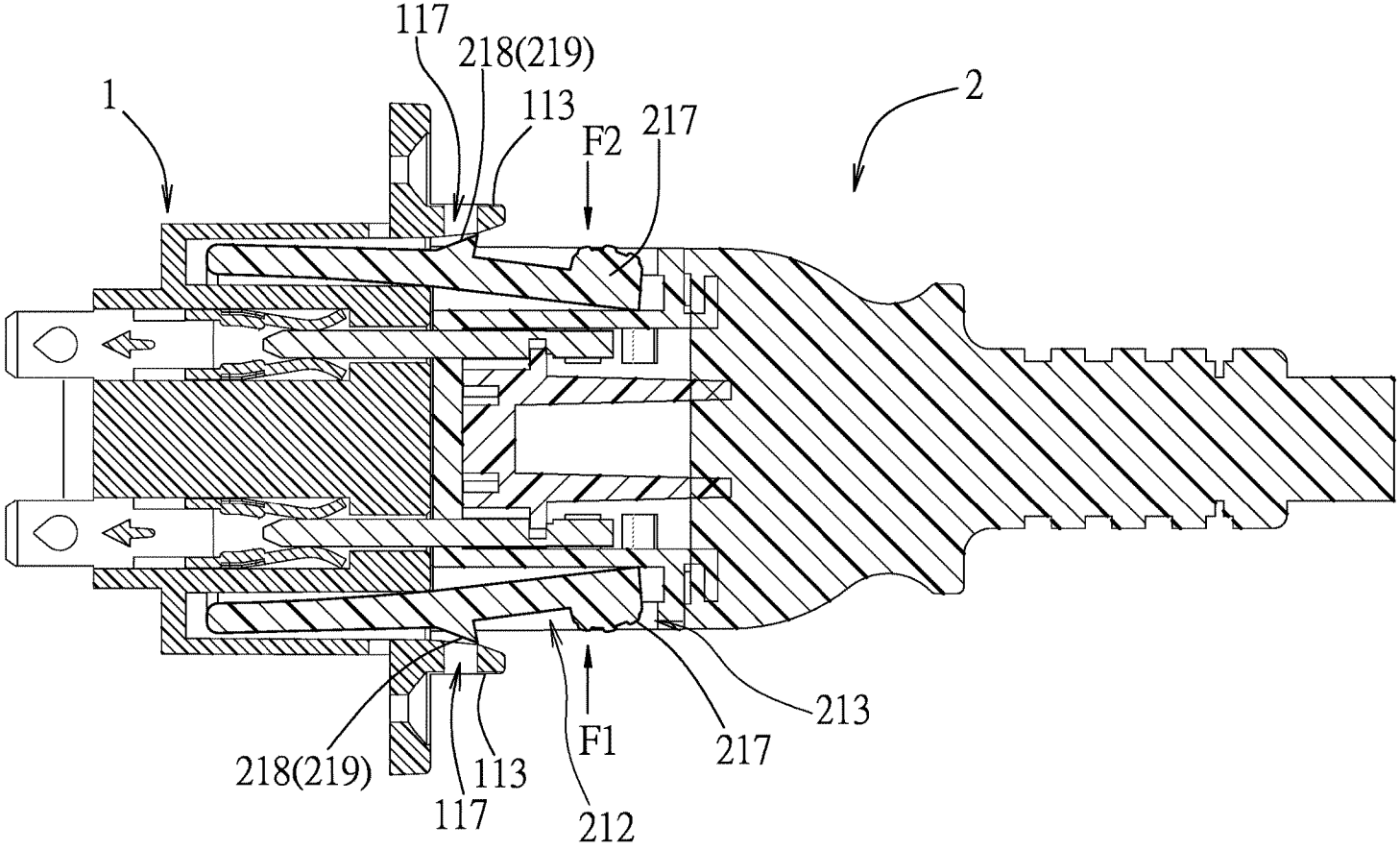
FIG. 6 is similar to FIG. 5 but illustrating the electrical plug connector to be removed from the electrical socket connector.

If the electrical plug connector 2 is intended to be removed from the electrical socket connector 1, the actuating free ends 217 of the retaining tongues 212 are manually pressed toward each other (see arrows F1 and F2 in FIG. 6) against the biasing forces of the retaining tongues 212 to disengage the retaining regions 218 of the retaining tongues 212 from the locking holes 117 of the lugs 113 so as to permit removal of the electrical plug connector 2.

In this embodiment, the actuating free end 217 has an embossed area 2170, and is disposed outwardly of the socket body 11 when the electrical socket connector 1 is brought into mating engagement with the electrical plug connector 2.

In this embodiment, the retaining region 218 has a protrusion (also denoted by numeral 218). The protrusion 218 includes an inclined area 219 and a stop area 220 which is disposed to immediately follow the inclined area 219. Each of the lugs 113 has a guiding surface 118. The guiding surfaces 118 of the lugs 113 are disposed to confront each other and are configured to permit the inclined areas 219 of the protrusions 218 of the retaining tongues 212 to respectively slide on the guiding surfaces 118 (see FIG. 4) so as to permit the protrusions 218 to respectively slide over the guiding surfaces 118 to thereby allow the stop areas 220 of the retaining tongues 212 to be in locked engagement in the locking holes 117 of the lugs 113, respectively (see FIG. 5).

In this embodiment, as shown in FIG. 1, the guiding surfaces 118 extend outward away from each other.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A plug-and-socket connector assembly comprising:

an electrical plug connector including a main body with a plurality of plug pins extending in a longitudinal direction, and a shroud which is made of an insulating material, and which extends from said main body in the longitudinal direction to surround said plug pins and to define an accommodation space, said shroud having two sidewalls opposite to each other in a transverse direction relative to the longitudinal direction; and an electrical socket connector configured to be brought into mating engagement with said electrical plug connector, and including a socket body made of an insulating material, and having a central body portion configured to be received in said accommodation space, a peripheral portion, and a clearance which is formed between said central body portion and said peripheral portion, and which is configured to accommodate said shroud, a flange extending radially from said peripheral portion, and having a forward surface, a plurality of socket holes which are formed in said central body portion, and which are configured to respectively receive said plug pins when said shroud is received in said clearance, and a plurality of terminals which are respectively disposed in said socket holes, and which are configured to be brought into electrical contact with said plug pins, respectively, wherein:

said electrical socket connector further includes two opposed lugs which extend forwardly and respectively from said forward surface of said flange in the longitudinal direction, and which are spaced apart from each other in the transverse direction so as to permit said lugs to be disposed outboard of said shroud when said electrical socket connector is brought into mating engagement with said electrical plug connector, each of said lugs having a leading edge and a locking hole formed between said leading edge and said forward surface of said flange, each of said lugs further having a ramped guiding surface extending from said leading edge toward said locking hole, said ramped guiding surfaces of said two opposed lugs confronting each other and extending outward away from each other; and said electrical plug connector further includes two retaining tongues each being formed by slitting a corresponding one of said sidewalls along two lengthwise lines and an interconnecting line so as to vest said retaining tongue with a biasing force, each of said retaining tongues having an actuating free end proximate to said main body, and a retaining region distal from said main body such that (i) when said electrical socket connector is brought into mating engagement with said electrical plug connector, said retaining region is snap-fitted in said locking hole of a corresponding one of said lugs, and (ii) if said electrical plug connector is intended to be removed from said electrical socket connector, said actuating free ends of said retaining tongues are manually pressed toward each other against the biasing forces of the retaining tongues to disengage said retaining regions of said retaining tongues from said locking holes of said lugs so as to permit removal of said electrical plug connector.

2. The plug-and-socket connector assembly according to claim 1, wherein said actuating free end has an embossed area.

3. The plug-and-socket connector assembly according to claim 1, wherein said retaining region has a protrusion including an inclined area and a stop area which is disposed to immediately follow said inclined area, said guiding surfaces of said lugs being and configured to permit said inclined areas of said protrusions of said retaining tongues to respectively slide on said guiding surfaces so as to permit said protrusions to respectively slide over said guiding surfaces to thereby allow said stop areas of said retaining tongues to be in locked engagement in said locking holes of said lugs, respectively.

* * * * *